US008584829B2

(12) United States Patent
Cieslikowski

(10) Patent No.: US 8,584,829 B2
(45) Date of Patent: Nov. 19, 2013

(54) METHOD OF SAFE TRANSFER OF FILTER SEGMENTS IN THE PROCESS OF PRODUCING MULTI-SEGMENT FILTERS

(75) Inventor: Bartosz Cieslikowski, Przysucha (PL)

(73) Assignee: International Tobacco Machinery Poland SP. Z O.O., Radom (PL)

( * ) Notice: Subject to any disclaimer, the term of this patent is extended or adjusted under 35 U.S.C. 154(b) by 22 days.

(21) Appl. No.: 13/376,307

(22) PCT Filed: Jun. 24, 2010

(86) PCT No.: PCT/PL2010/000052

§ 371 (c)(1),
(2), (4) Date: Dec. 5, 2011

(87) PCT Pub. No.: WO2011/008113

PCT Pub. Date: Jan. 20, 2011

(65) Prior Publication Data

US 2012/0073935 A1 Mar. 29, 2012

(30) Foreign Application Priority Data

Jul. 15, 2009 (PL) ..... 388549

(51) Int. Cl.
*B65G 43/00* (2006.01)

(52) U.S. Cl.
USPC ..... 198/460.1; 198/441

(58) Field of Classification Search
USPC ..... 198/460.1, 437, 440, 441, 430, 431, 198/419.3, 358
See application file for complete search history.

(56) References Cited

U.S. PATENT DOCUMENTS 3,067,754 A 12/1962 Pinkham et al.
3,254,752 A * 6/1966 Bauch et al. ..... 198/358
3,357,320 A 12/1967 Sexstone et al.

(Continued)

FOREIGN PATENT DOCUMENTS

EP 1 767 107 A1 3/2007
GB 1146259 A 3/1969

(Continued)

OTHER PUBLICATIONS

International Search Report of PCT/PL2010/000052, mailing date Jan. 19, 2011.

(Continued)

*Primary Examiner* — Gene Crawford
*Assistant Examiner* — Keith R Campbell
(74) *Attorney, Agent, or Firm* — Westerman, Hattori, Daniels & Adrian, LLP

(57) ABSTRACT

A method of safe transfer of filter segments to a grouping belt in a process of producing multi-segment filters. The method includes transferring the filter segments using a filter segments' flow track, wherein the filter segments' flow track includes, consecutively, a zone of delivery of prepared segments, a zone of separation of delivered segments by a separating unit, a zone of intercepting of separated segments by a transferring unit, a zone of transferring segments by the transferring unit, and a zone of placing the segments by the transferring unit on a horizontal path of the grouping belt; detecting incorrect flow of filter segments in any zone and/or between the zones; and moving the transferring unit and/or the separating unit out of the filter segments' flow track if an incorrect flow of filter segments is detected, and interrupting the process of producing multi-segment filters.

11 Claims, 5 Drawing Sheets

(56) References Cited

U.S. PATENT DOCUMENTS

Figure 1:
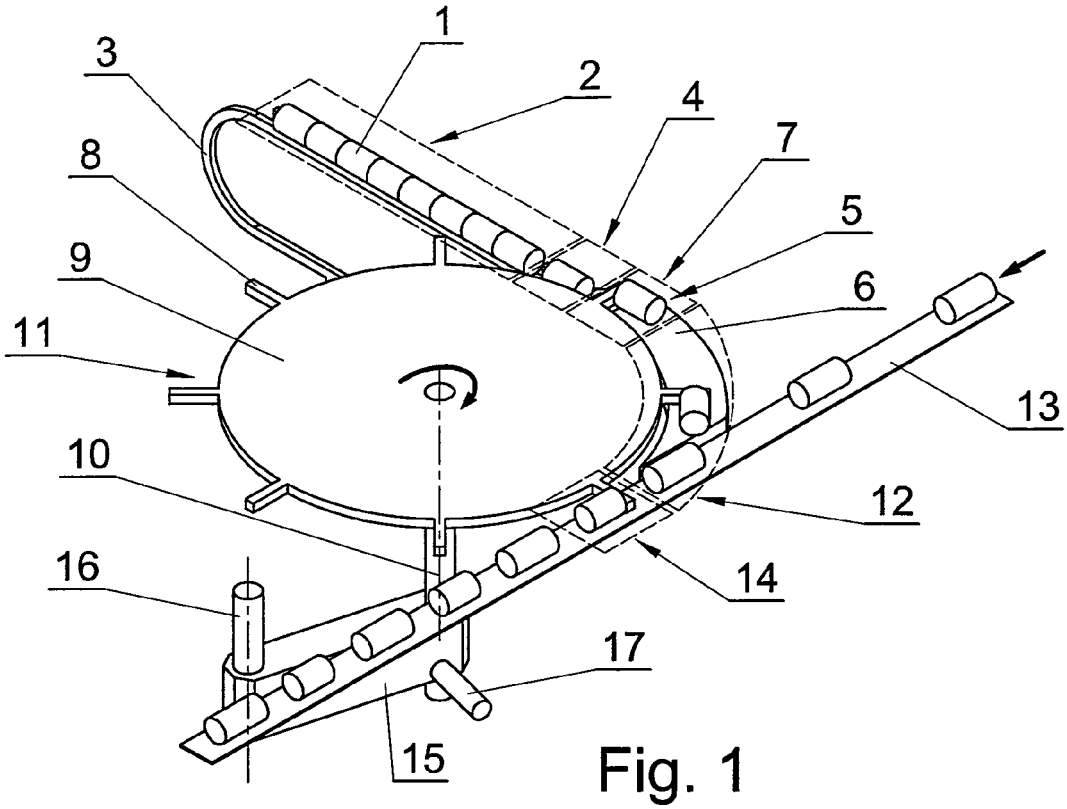

| | | | | |
|---|---|---|---|---|
| 3,561,588 | A * | 2/1971 | Nash | 198/358 |
| 3,605,982 | A * | 9/1971 | Adler | 198/358 |
| 4,746,002 | A * | 5/1988 | Wysocki | 198/367 |
| 5,078,255 | A * | 1/1992 | Haley | 198/358 |
| 5,784,857 | A * | 7/1998 | Ford et al. | 53/201 |
| 6,843,361 | B2 * | 1/2005 | Maingonnat et al. | 198/456 |
| 2009/0145449 | A1 | 6/2009 | Cieslikowski et al. | |

FOREIGN PATENT DOCUMENTS

| | | | |
|---|---|---|---|
| GB | 2 002 220 | A | 2/1979 |
| GB | 2151901 | A | 7/1985 |
| WO | 2009/074540 | A1 | 6/2009 |

OTHER PUBLICATIONS

Written Opinion of PCT/PL2010/000052, mailing date Jan. 19, 2011.

* cited by examiner

METHOD OF SAFE TRANSFER OF FILTER SEGMENTS IN THE PROCESS OF PRODUCING MULTI-SEGMENT FILTERS

The object of the invention is a method of safe transfer of filter segments to a grouping belt in the process of producing multi-segment filters used in the tobacco industry for cigarettes.

In the tobacco industry, there is a demand for multi-segment filters used for the manufacture of cigarettes, which consist of at least two types of segments made of various filtrating materials; such segments may be soft, filled, for example, with nonwoven cloth, paper, cellulose acetate, or hard, filled with granulate, sintered elements, or hollow cylinders. The created series of segments is then divided appropriately into filters used for the manufacture of cigarettes. One known method of making multi-segment filters is a line method, whose operating principle has been presented several times in patent descriptions owned by British company MOLINS Ltd. For example, British description No. GB 1.146.259 shows a method for manufacturing a cigarette with a filter consisting of at least three different segments, and a machine enabling the use of such method, consisting of three modules. Segments are formed by cutting filter rods with circular cutters moving peripherally on three different drums, and the cut sets of segments are removed from each groove on the drum with a chain conveyor equipped with drivers, working always in a vertical plane inclined by a slight angle from the axis of the cutting drum. Segments are then removed by ejectors from the chain conveyor to a rotating intermediate disk mounted horizontally, whose drivers, situated on the perimeter, transfer segments endwise along the horizontal track of the grouping belt to a worm drum regulating the movement of the segments, while earlier, segments of another type, obtained by cutting filter rods on drums in the other modules, are fed in a similar manner into the empty spaces between the segments onto the grouping belt. In the presented structure the intermediate disk of the middle module has also drivers executing to-and-fro motion when encountering resistance of defined strength, caused by wedging of filter segments. Such transfer is possible due to using a ball clutch, which protects the drivers against damage in case of malfunction. Another British patent description filed by the same company, No. GB 2.151.901 presents a device, in which rods filled with tobacco are fed to the horizontal track of the grouping belt by a set of disks mounted horizontally, and the filter segments cut on the drum are inserted respectively into the empty spaces between the rods by means of rotating discs placed vertically above the belt track. In known machines designated for placing filters segments on the grouping belt, there is no comprehensive monitoring process, which in case of reporting a disturbance in the process of feeding filter segments in any zone of the machine would cause immediate response of the control system towards disconnection of cooperating units, because under production conditions it may happen that defective segments are fed to the filters manufacturing process, for example, of wrong dimensions or improperly formed, which will create jamming in the movement of segments and increase resistance to motion of mechanisms. If segments are of adequate quality, but the unit placing the segments on the grouping belt before placing each next segment positions segments incorrectly, or where subsequent units placing the segments are not synchronized with each other, there may be a collision of the transferring unit with segments earlier placed on the grouping belt. This disadvantage can contribute to damage of the units and causes a risk of production of incomplete bars of multi-segment filters.

The existing attempts to protect certain elements of the unit against damage do not protect completely proper functioning of the whole process.

According to the invention, the method of safe transfer of filter segments to the grouping belt in the process of producing multi-segment filters used in the tobacco industry, wherein the process progresses, consecutively, in the zone of delivery of the prepared segments, in the zone of separation of the delivered segments by a separating unit, in the zone of intercepting of the separated segments by the transferring unit, in the zone of transferring the segments by the transferring unit, and in the zone of placing the segments by the transferring unit on the horizontal path of the grouping belt, is characterized in that in the case of incorrect flow of filter segments in any zone and/or between the zones, the process of the transfer of filter segments in at least one zone is interrupted. Detection of incorrect flow of filter segments is effected by checking the resistance to motion of mechanisms by means of checking the driving torque of a motor in each zone, and comparison with the nominal torque by a control system. The said detection may also be effected by checking the change of the position of the mechanisms by means of position sensors fixed in the transferring unit and/or in the separating unit. Interruption of the process of the transfer of filter segments is effected by removal of the transferring unit and/or the separating unit out of the filter segments' flow track. Removal of the transferring unit may be effected by means of a pneumatic cylinder moving the unit along its guide of the axis parallel to the axis of rotation of the transferring unit or by means of a pneumatic cylinder rotating the unit around the axis of a guide parallel to the axis of rotation of the transferring unit. In another execution of the method, removal of the separating unit is effected by means of a pneumatic cylinder moving the unit along its guide of the axis parallel to the axis of rotation of the transferring unit, and the transferring unit is removed in the opposite direction by means of a pneumatic cylinder along its guide of axis parallel to the axis of rotation of the transferring unit. In yet another execution of the method, where the transferring unit and the separating unit are mounted together on a guide, both units are removed together by means of a pneumatic cylinder moving the units along a guide of axis perpendicular to the axis of rotation of the transferring unit. Restarting of the filter making process may be effected after removal of the cause of the incorrect flow of filter segments in any zone of the transfer process and/or between the zones. The presented method permits ongoing monitoring of the production process and immediate response of the control system interrupting the process in case of detection of irregularities, owing to which the possibility of damage to the mechanisms used, as well as the risk of production of incomplete rods of multi-segment filters has been eliminated.

Figure 2:
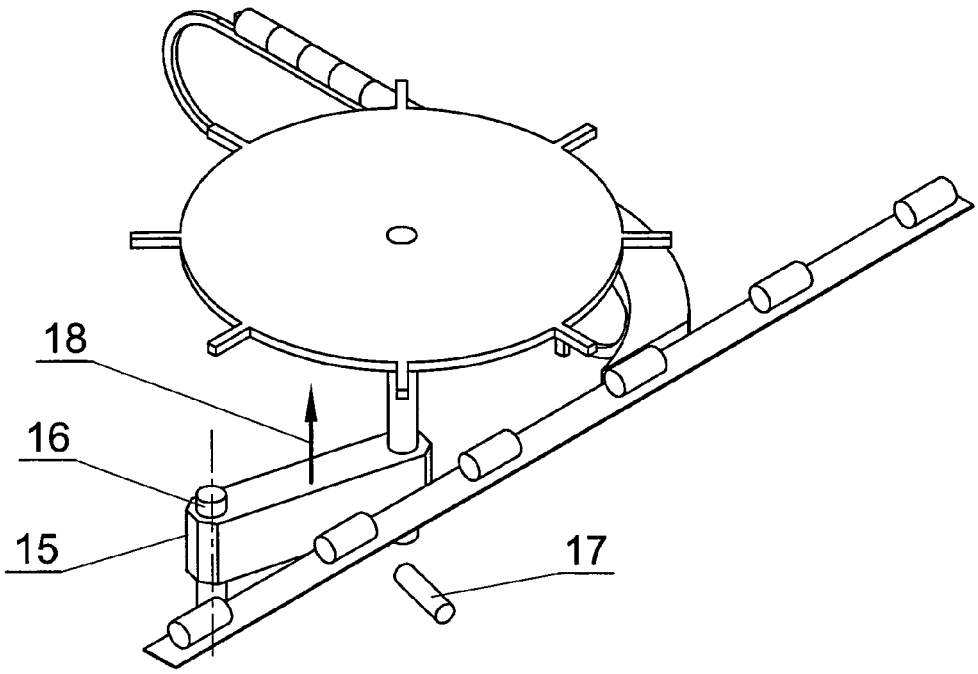
Figure 3:
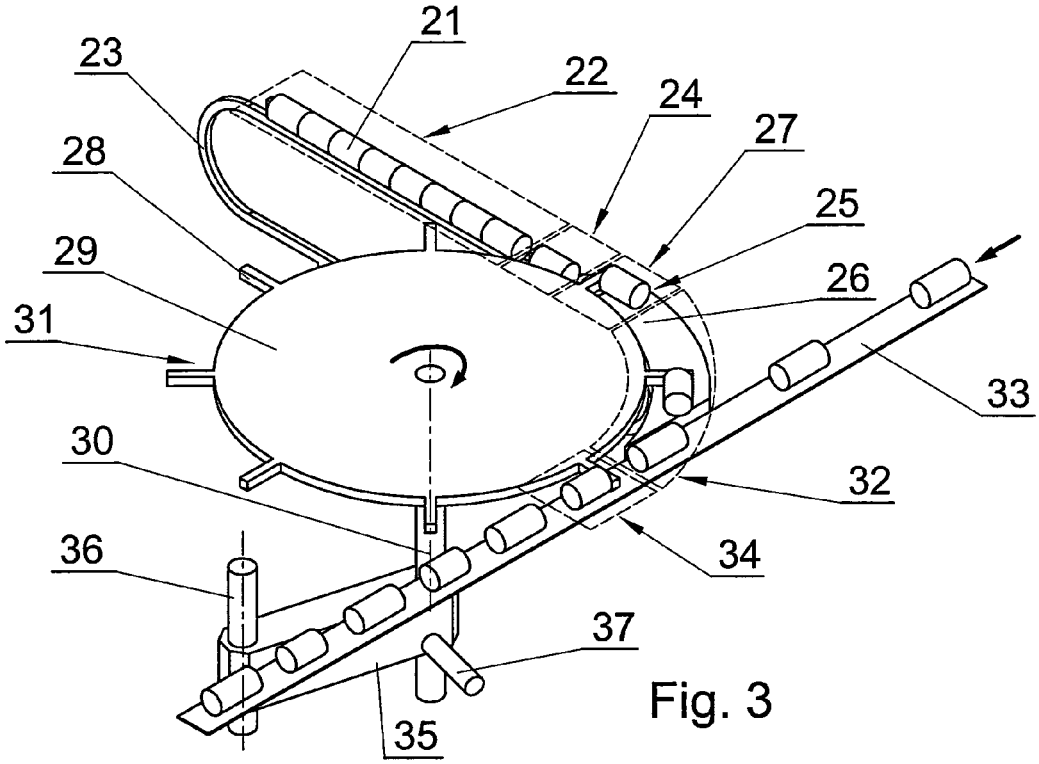
Figure 4:
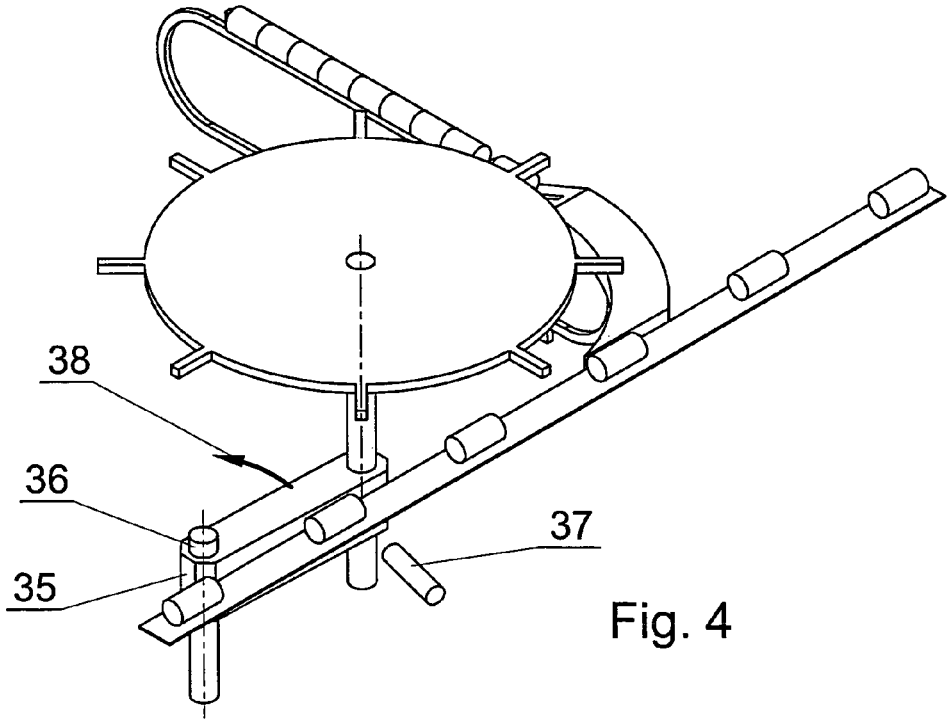
Figure 5:
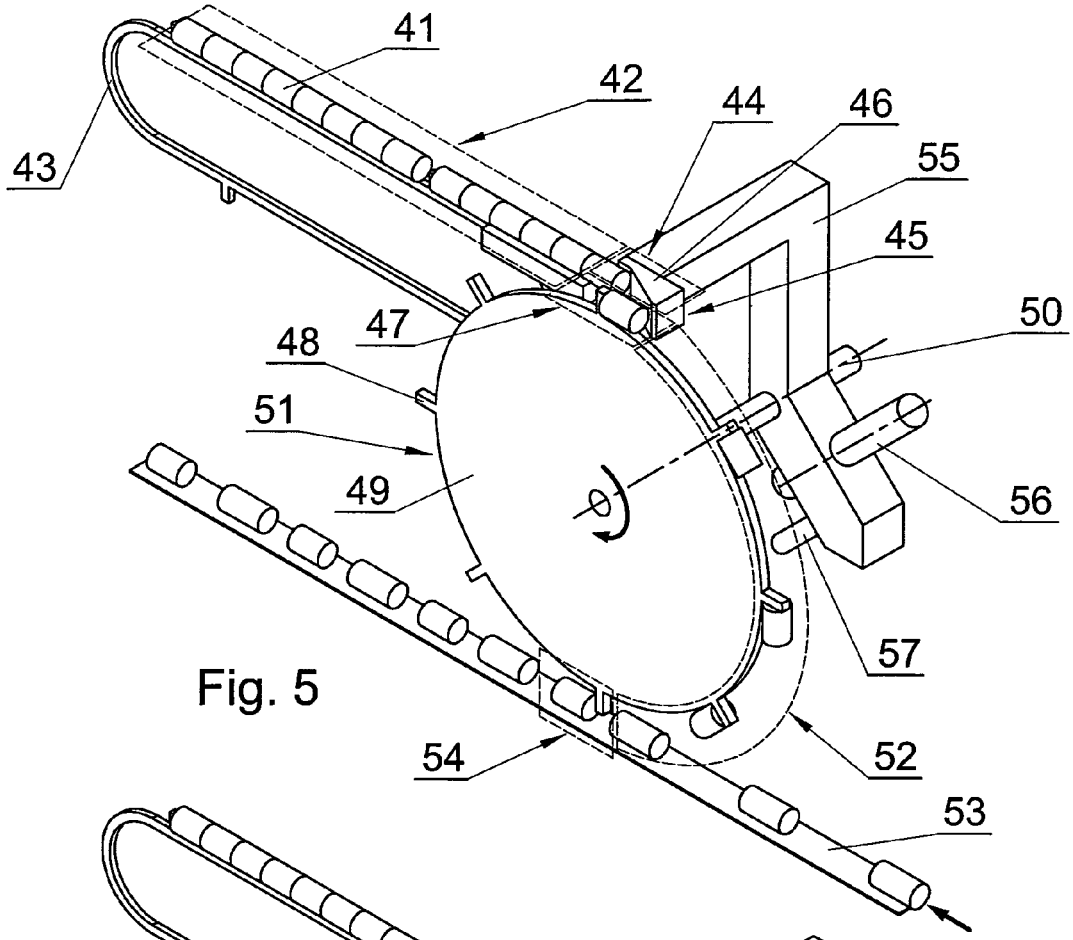
Figure 6:
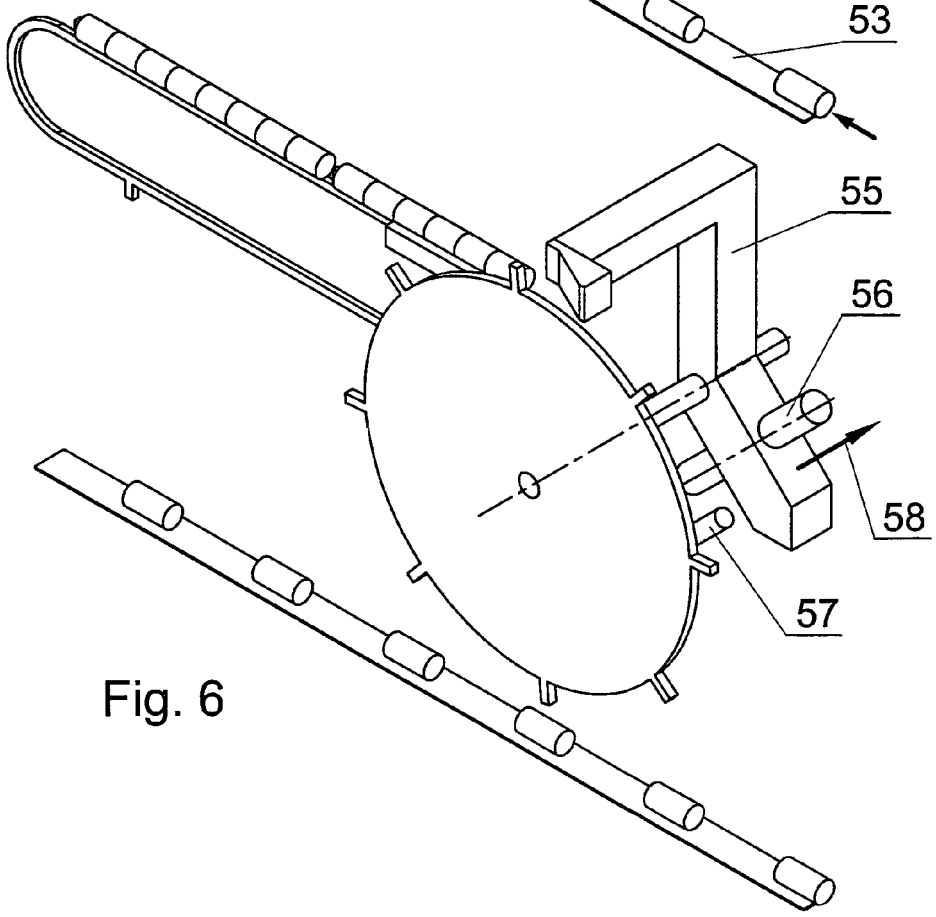
Figure 7:
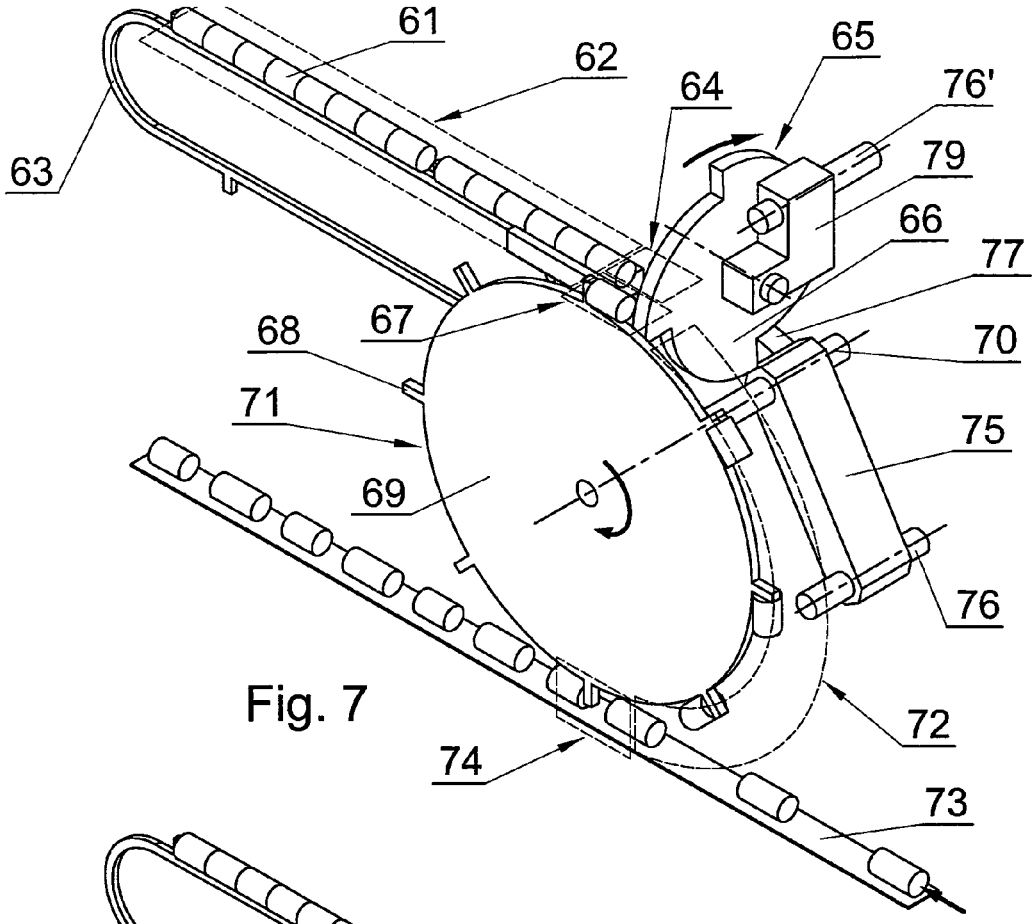
Figure 8:
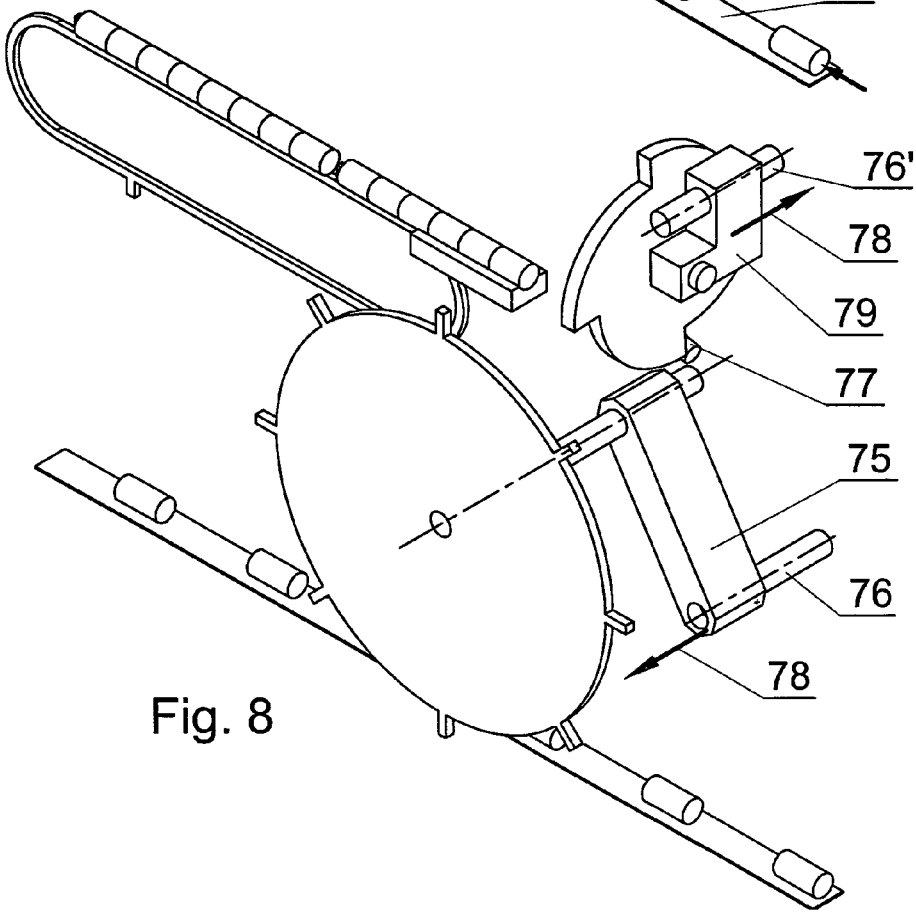
Figure 9:
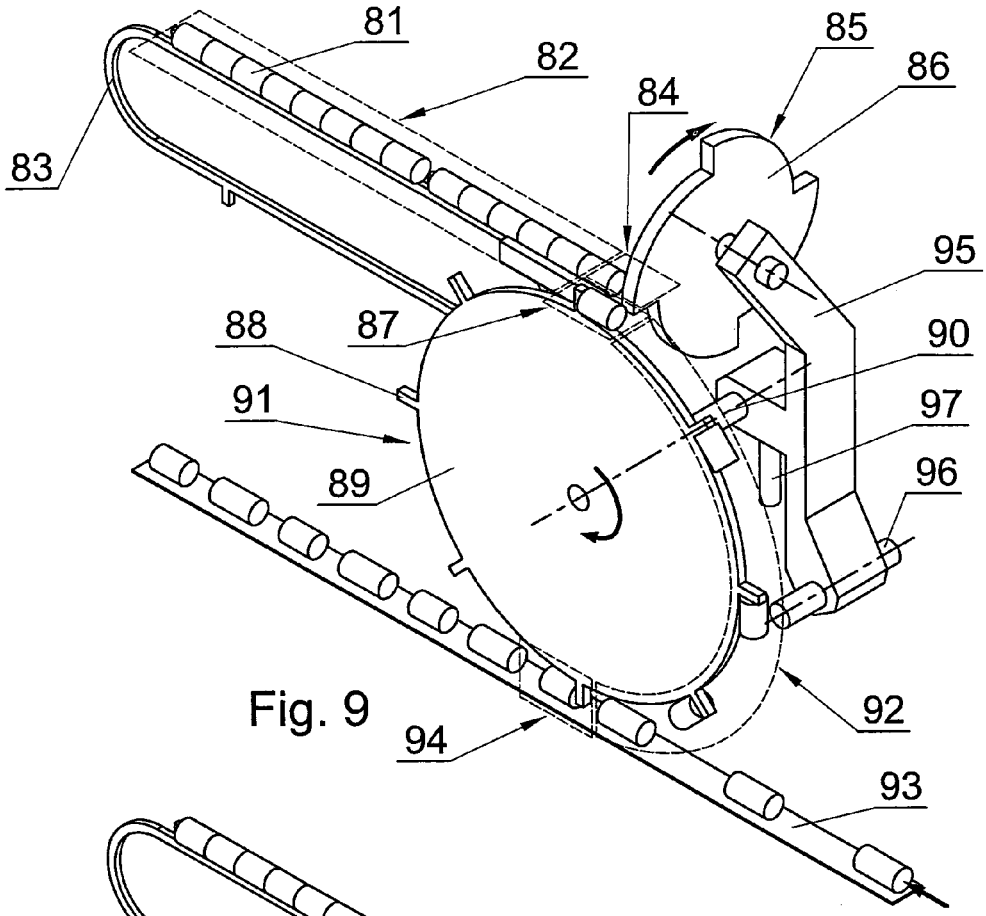
Figure 10:
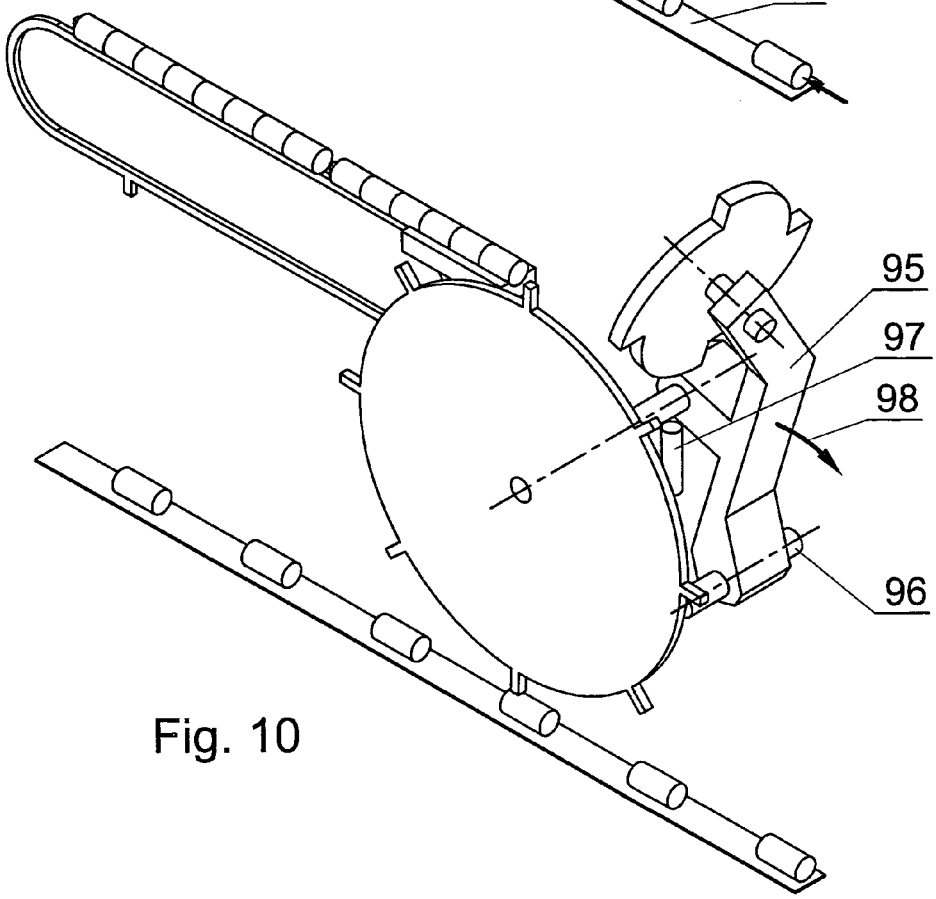

For better understanding, the object of the invention has been illustrated in examples of embodiment in figures, in which FIG. 1 presents the phase of transferring segments, and FIG. 2 the phase of interruption of the process according to Example I of the invention's embodiment, in which a transferring unit was used in the form of a rotating disk mounted horizontally on a vertical axis and sliding along such axis, FIG. 3 presents the phase of transferring segments, and FIG. 4 the phase of interruption of the process according to Example II of the invention's embodiment, in which a transferring unit was used in the form as in Example I, with the rotating disk removed through rotation around an axis parallel to the axis of the disk, FIG. 5 presents the phase of transferring segments, and FIG. 6 the phase of interruption of the process according to Example III of the invention's embodiment, in which a transferring unit was used in the form of a rotating disk mounted vertically on a horizontal axis and sliding along an axis perpendicular to the axis of rotation, with a separating unit, FIG. 7 presents the phase of transferring segments, and FIG. 8 the phase of interruption of the process according to Example IV of the invention's embodiment, in which a transferring unit was used in the form as in Example III, which is moved along an axis parallel to the axis of rotation, and the separating unit is moved along an axis parallel to the axis of rotation, but in the opposite direction, while FIG. 9 presents the phase of transferring segments, and FIG. 10 the phase of interruption of the process according to Example V of the invention's embodiment, in which a transferring unit was used in the form as in Example III, mounted together with the separating unit on an axis parallel to the axis of rotation of the disk and removed by rotation around such axis, and in the drawing, the motion of elements preceding the phase of interruption of the process has been indicated by arrows accordingly.

EXAMPLE I

FIG. 1 presents a situation, wherein properly prepared segments 1 are delivered as a produced sequence through a zone 2, constituting a transporter 3 to a zone 4, where they are separated by a separating unit 5 in the form of a permanently fixed ramp 6 and transferred in a zone 7 between drivers 8 a of rotating disk 9 mounted vertically on a horizontal axis 10, which constitute a transferring unit 11. The separated segments 1 intercepted in the zone 7 by drivers 8 are transferred individually in a zone 12 and placed on the horizontal track of a grouping belt 13 in a zone 14, through which they are transferred to further modules in order to produce the required group of the segments 1. The axis 10 of the disk 9 is mounted in a horizontal extension arm 15 mounted slidably on a guide 16 parallel to the axis 10, with extension arm 15 cooperating with a sensor 17 situated near the axis 10. Should the sensor 17 detect a change in the position of the disk 9 with axis 10, or in the case of detection of increased resistance to motion of the mechanisms, the control system shall cause activation of a pneumatic cylinder not shown in the drawing, which moves the extension arm 15 with the transferring unit 11 in the direction shown by arrow 18 on FIG. 2, causing the interruption of the process of transferring the segments 1, which causes the interruption of the filters production process.

EXAMPLE II

FIG. 3 presents a situation, wherein properly prepared segments 21 are delivered as a produced sequence through zone 22, constituting a transporter 23 to a zone 24, where they are separated by a separating unit 25 in the form of permanently fixed ramp 26 and transferred in a zone 27 between drivers 28 of a rotating disk 29 mounted horizontally on a vertical axis 30, which constitute a transferring unit 31. The separated segments 21 intercepted in the zone 27 by drivers 28 are transferred individually in a zone 32 and placed on the horizontal track of a grouping belt 33 in a zone 34, through which they are transferred to further modules in order to produce the required group of the segments 21. The axis 30 of the disk 29 is mounted in a horizontal extension arm 35 mounted rotationally on a guide 36 parallel to the axis 30, with the extension arm 35 cooperating with a sensor 37 situated near the axis 30. Should the sensor 37 detect a change in the position of the disk 29 with the axis 30 or in the case of detection of increased resistance to motion of mechanisms, the control system shall cause activation of a pneumatic cylinder not shown in the drawing, which rotates the extension arm 35 with the transferring unit 31 in the direction shown by an arrow 38 on FIG. 4, causing the interruption of the process of transferring the segments 21, which causes the interruption of the filters production process.

EXAMPLE III

FIG. 5 presents a situation, wherein properly prepared segments 41 are delivered as a produced sequence through zone 42, constituting a transporter 43 to a zone 44, where they are separated by a separating unit 45 in the form of a ramp 46 and transferred in a zone 47 between the drivers 48 of a rotating disk 49 mounted vertically on a horizontal axis 50, which constitute a transferring unit 51. The separated segments 41 intercepted in the zone 47 by the drivers 48 are transferred individually in a zone 52 and placed on the horizontal track of a grouping belt 53 in a zone 54, through which they are transferred to further modules in order to produce the required group of the segments 41. On the axis 50 of the disk 49 is also mounted an extension arm 55, one end of which is the ramp 46, with the extension arm 55 mounted slidably on a guide 56 perpendicular to the axis 50 and cooperates with a sensor 57 situated near the guide 56. Such a method of mounting makes the separating unit 45 fixedly coupled with the transferring unit 51. Should the sensor 57 detect a change in the position of the disk 49 or the ramp 46 caused for instance by the driver 48 hitting the segment 41 earlier incorrectly positioned on the grouping belt 53, or in case of detection of increased resistance to motion of mechanisms, the control system shall cause activation of a pneumatic cylinder not shown in the drawing, which moves the extension arm 55 with the ramp 46 constituting the separating unit 45 and the transferring unit 51, in the direction shown by an arrow 58 on FIG. 6, causing interruption of the process of transferring the segments 41, which causes the interruption of the filters production process.

EXAMPLE IV

FIG. 7 presents a situation, wherein properly prepared segments 61 are delivered as a produced sequence through a zone 62, constituting a transporter 63 to a zone 64, where they are separated by a separating unit 65 in the form of a rotating disk cam 66 and transferred in a zone 67 between the drivers 68 of a rotating disk 69 mounted vertically on a horizontal axis 70, which constitutes a transferring unit 71. The separated segments 61 intercepted in the zone 67 by the drivers 68 are transferred individually in a zone 72 and placed on the horizontal track of a grouping belt 73 in a zone 74, through which they are transferred to further modules in order to produce the required group of the segments 61. The axis 70 of the disk 69 is mounted in a perpendicular extension arm 75, which in turn is mounted slidably on the guide 76 parallel to the axis 70. The rotating disk cam 66 is mounted with its axis of rotation perpendicular to the axis 70 of the disk 69, in a yoke 79 mounted slidably in a guide 76' parallel to the axis 70, so that the separating unit 65 and the transferring unit 71 are not interconnected, but affect a sensor 77 situated between the units 65 and 71. Should the sensor 77 detect changes in the position of the disk 69 and/or the disk cam 66 caused for instance by the driver 68 hitting the segment 61 earlier incorrectly positioned on the grouping belt 73, or in the case of detection of increased resistance to motion of mechanisms, the control system shall cause activation of a pneumatic cylinders not shown on the drawing, one of which slides an extension arm, 75, and the other yoke 79 in opposite directions shown by arrows 78 on FIG. 8, causing the interruption of the process of transferring the segments 61, which causes the interruption of the filters production process.

EXAMPLE V

FIG. 9 presents a situation, wherein properly prepared segments 81 are delivered as a produced sequence through a zone 82, constituting a transporter 83 to a zone 84, where they are separated by a separating unit 85 in the form of a rotating disk cam 6 and transferred in a zone 87 between the drivers 88 of a rotating disk 89 mounted vertically on a horizontal axis 90, which constitutes a transferring unit 91. The separated segments 81 intercepted in the zone 87 by the drivers 88 are transferred individually in a zone 92 and placed on the horizontal track of a grouping belt 93 in a zone 94, through which they are transferred to further modules in order to produce the required group of the segments 81. On the axis 90 of the disk 89 is also mounted an extension arm 95, on one end of which is mounted the rotating disk cam 86, with the axis of rotation perpendicular to the axis 90 of the disk 89, and the other end of the extension arm. 95 is fixed rotationally on a guide 96 parallel to the axis 90. The extension arm 95 cooperates with a sensor 97 situated near the axis 90 of the disk 89, and since the separating unit 85 and the transferring unit 91 are fixedly attached to the extension arm 95, any changes in the position of the disk cam 86 and/or the disk 89 are detected by the sensor 97. Information of the said position changes, caused for instance by the driver 88 hitting the segment 81 earlier incorrectly positioned on the grouping belt 73, or information of detection of increased resistance to motion of mechanisms is transferred to the control system, causing activation of a pneumatic cylinder not shown on the drawing, which rotates the extension arm 95 together with the separating unit 85 and the transferring unit 91 in the direction shown by an arrow 98 in FIG. 10, causing the interruption of the process of transferring the segments 81, which causes the interruption of the filters production process.

EXAMPLE VI

In the example presented on FIG. 7 and FIG. 8, both the transporter 63 in the delivery zone 62, the rotating disk cam 66 in the separating unit 65, the rotating disk 69 in the transfer unit 71 and the grouping belt 73, have their own, independent drives, not shown in the drawing. Measurement of the torque in any motor means an increase of to motion of the transfer of the segments 81 in the respective zone. In such case, the control system causes disconnection of drive in this zone and activation of pneumatic cylinder not presented in the drawing, which removes the separating unit 65 and/or the transferring unit 91, interrupting the process of transferring the segments 81, which causes the interruption of the filters production process.

The examples presented do not exhaust all possibilities of use of the method as per the invention, because it is possible to change subassemblies, as well as to combine various solutions including characteristic features of the method.

The invention claimed is:

1. A method of safe transfer of filter segments to a grouping belt in a process of producing multi-segment filters, comprising:

transferring the filter segments using a filter segments' flow track, wherein the filter segments' flow track comprises, consecutively, a zone of delivery of prepared segments, a zone of separation of delivered segments by a separating unit, a zone of intercepting of separated segments by a transferring unit, a zone of transferring segments by the transferring unit, and a zone of placing the segments by the transferring unit on a horizontal path of the grouping belt, detecting incorrect flow of filter segments in any zone and/or between the zones, and moving the transferring unit and/or the separating unit out of the filter segments' flow track if an incorrect flow of filter segments is detected and interrupting the process of producing multi-segment filters.

2. The method as in claim 1, wherein the detecting incorrect flow of filter segments comprises checking a resistance to motion of mechanisms and/or by checking a change of a position of the mechanisms.

3. The method as in claim 2, wherein the checking the resistance to motion of the mechanisms comprises checking a driving torque of motor in each zone, and comparison with a nominal torque by a control system.

4. The method as in claim 2, wherein the checking of the change of the position of the mechanisms comprises checking the change of position by position sensors fixed in the transferring unit and/or in the separating unit.

5. The method as in claim 1, wherein the moving of the transferring unit comprises a pneumatic cylinder moving the transferring unit along its guide of an axis parallel to an axis of rotation of the transferring unit.

6. The method as in claim 1, wherein the moving of the transferring unit comprises a pneumatic cylinder rotating the transferring unit around an axis of a guide parallel to an axis of rotation of the transferring unit.

7. The method as in claim 1, wherein the moving of the transferring unit comprises a pneumatic cylinder moving the transferring unit along its guide of an axis parallel to an axis of rotation of the transferring unit, and the transferring unit is moved in an opposite direction by the pneumatic cylinder along a guide of the axis parallel to the axis of rotation of the transferring unit.

8. The method as in claim 1, wherein the moving of the transferring unit and/or the separating unit comprises moving the transferring unit and the separating unit, mounted together on a guide, together by means of a pneumatic cylinder moving the transferring unit and the separating unit along the guide of an axis perpendicular to an axis of rotation of the transferring unit.

9. The method as in claim 1, wherein the moving of the transferring unit and/or the separating unit comprises moving the transferring unit and the separating unit, mounted together on a guide, are removed together by means of a pneumatic cylinder rotating the transferring unit and separating unit around an axis of the guide parallel to an axis of rotation of the transferring unit.

10. The method as in claim 1, further comprising restarting of the process of producing multi-segment filters after removal of a cause of the incorrect flow of filter segments.

11. The method as in claim 2, further comprising restarting of the process of producing multi-segment filters after removal of a cause of the incorrect flow of filter segments.

* * * * *